US007655856B2

(12) United States Patent
Nakamura

(10) Patent No.: US 7,655,856 B2
(45) Date of Patent: Feb. 2, 2010

(54) MUSICAL SOUNDING PRODUCING APPARATUS, MUSICAL SOUND PRODUCING METHOD, MUSICAL SOUND PRODUCING PROGRAM, AND RECORDING MEDIUM

(75) Inventor: Shunsuke Nakamura, Nagoya (JP)

(73) Assignee: Toyota Motor Kyushu Inc., Fukuoka (JP)

( * ) Notice: Subject to any disclaimer, the term of this patent is extended or adjusted under 35 U.S.C. 154(b) by 492 days.

(21) Appl. No.: 11/629,235

(22) PCT Filed: Jun. 9, 2004

(86) PCT No.: PCT/JP2004/008037

§ 371 (c)(1),
(2), (4) Date: Dec. 8, 2006

(87) PCT Pub. No.: WO2005/122134

PCT Pub. Date: Dec. 22, 2005

(65) Prior Publication Data

US 2008/0289482 A1 Nov. 27, 2008

(51) Int. Cl.
*G10H 7/00* (2006.01)

(52) U.S. Cl. ..... 84/645

(58) Field of Classification Search ..... 84/609, 84/645

See application file for complete search history.

(56) References Cited

U.S. PATENT DOCUMENTS

| | | | | |
|---|---|---|---|---|
| 5,684,259 | A * | 11/1997 | Horii | 84/600 |
| 5,689,078 | A * | 11/1997 | McClard | 84/600 |
| 7,525,034 | B2 * | 4/2009 | Nease et al. | 84/485 R |
| 2006/0075885 | A1 * | 4/2006 | Bailey et al. | 84/630 |
| 2008/0289482 | A1 * | 11/2008 | Nakamura | 84/645 |

FOREIGN PATENT DOCUMENTS

| | | |
|---|---|---|
| JP | 64-91188 | 4/1989 |
| JP | 4-174696 | 6/1992 |
| JP | 6-102877 | 4/1994 |
| JP | 08-314462 | 11/1996 |
| JP | 2629740 | 4/1997 |
| JP | 10-26978 | 1/1998 |
| JP | 11-175061 | 7/1999 |

(Continued)

*Primary Examiner*—Jeffrey Donels
(74) *Attorney, Agent, or Firm*—Jordan and Hamburg LLP

(57) ABSTRACT

The present invention aims at the production of musical sounds by calculating motion data based on inputted image data using a simple technique without preliminarily preparing playing information or the like and by producing musical sounds based on the calculated data. A musical sound producing apparatus includes an operation part specifying means which extracts motion data indicative of motions from differentials of respective pixels corresponding to image data of a plurality of frames using image data for respective frames as an input; a musical sound producing means which produces musical sound data containing a sound source, a sound scale and a sound level in accordance with the motion data specified by the motion part specifying means; and an output means which outputs the musical sound data produced by the musical sound producing means, wherein an image database in which patterns are registered and an image matching means are provided, and a musical sound synthesizing means is provided to the musical sound producing means, in the musical sound producing means, so as to synthesize the musical sound data with other sound data, thereby producing the musical sound data.

9 Claims, 8 Drawing Sheets

FOREIGN PATENT DOCUMENTS

| | | |
|---|---|---|
| JP | 2000-276138 | 10/2000 |
| JP | 2000-276139 | 10/2000 |
| JP | 2001-83969 | 3/2001 |
| JP | 2002-311949 | 10/2002 |
| JP | 3098423 | 10/2003 |

* cited by examiner

MUSICAL SOUNDING PRODUCING APPARATUS, MUSICAL SOUND PRODUCING METHOD, MUSICAL SOUND PRODUCING PROGRAM, AND RECORDING MEDIUM

BACKGROUND OF THE INVENTION

1. Technical Field

The present invention relates to a musical sound producing apparatus, a musical sound producing method, a musical sound producing program, and recording medium for automatically producing musical sound data corresponding to image data.

2. Background Art

As a technique which controls playing corresponding to an image, for example, Japanese Patent 2629740 discloses a technique which controls tempo or the like by making use of a profile of an object to be photographed. In this technique, respective signals of R (red), G (green), B (blue) are separated from inputted video signals, and gray scale data indicative of gray scales are generated as digital data for respective colors. Then, the object to be photographed is specified based on the gray scale data of respective colors and preset threshold value data thus detecting the profile of the object to be photographed, and the playing is controlled corresponding to "the complexity of the detected profile".

Japanese Laid-open Patent Publication 2002-276138 discloses a technique which produces musical sound by detecting a position of a moving manipulation object, wherein the position of the specified manipulation object having a fixed shape is detected, and musical sounds are generated corresponding to both elements consisting of a traveling time from an arbitrary position to a current position of the manipulation object and the current position. To be more specific, when a position of a specified portion of the object to be photographed is detected, musical sound which is produced is allocated to a sound producing region set on an image display screen, and after a lapse of a predetermined time from the determination that the specified portion is not present in one region on the image display screen, it is determined that the specified portion exists in another region on the different image display screen, and the determined another region belongs to the sound producing region, the musical sound allocated to the sound producing region is generated.

On the other hand, as a technique which overcomes a problem which arises in the production of musical sound by catching the movement of an object, for example, Japanese Laid-open Patent Publication 2000-276139 discloses a technique in which a plurality of motion vectors is extracted from each block of a supplied image, one control vector is calculated from the plurality of motion vectors, and musical sound is produced based on the calculated control vector.

In the method which extracts the plurality of motion vectors from each block of the image, in respective blocks (16×16) corresponding to a specified image frame and an image frame which follows the specified image frame, pixels which exhibit the least color difference are picked up and the difference of positions of these pixels is set as the motion vector.

However, in the technique disclosed in Japanese Patent 2629740, it is necessary to determine the complexity of a profile of an object to be photographed by using a still image as an object, by decomposing color signals of the still image, specifying the object to be photographed by threshold inspections for respective colors, and by detecting a profile of the object to be photographed. Accordingly, this technique is an existing sound data modifying technique in view of a drawback that a load of processing is increased and the complexity of the profile. Accordingly, Japanese Patent 2629740 has a drawback that the patent has no idea of producing musical sound.

The technique disclosed in Japanese Laid-open Patent Publication 2000-276138 discloses the judgment on the movement which follows a registered specified operator and aims at the production of musical sound. However, this technique has a drawback that musical sound is not produced from an arbitrary motion picture frame.

The technique disclosed in Japanese Laid-open Patent Publication 2000-276139 copes with a task to produce musical sounds based on the analysis of the motion and also develops a method which detects motion vectors by performing the analysis in a limited specified region for reducing a load on the analysis. However, this technique is a technique which cannot avoid a fundamental drawback that a large load is applied to the calculation of the motion vectors.

It is an object of the present invention to provide a technique which, using continuous motion picture frames as objects, can take out motion data using a simple method and can produce musical sound data based on this taken-out motion data. It is also an object of the present invention to construct a unique application field by further combining the musical sound data produced in such a manner with an existing technique.

Accordingly, the present invention provides a musical sound producing apparatus, a musical sound producing method, a musical sound producing program and a recording medium for automatically producing musical sound data by calculating motion data based on inputted image data using a simple technique without preparing playing information or the like in advance.

SUMMARY OF THE INVENTION

To overcome the above-mentioned drawbacks, a first aspect of the present invention is a a musical sound producing apparatus which includes an operation part specifying means which extracts motion data indicative of motions from differentials of respective pixels corresponding to image data of a plurality of frames using image data for respective frames as an input, a musical sound producing means which produces musical sound data containing a sound source, a sound scale and a sound level in accordance with the motion data specified by the motion part specifying means, and an output means which outputs the musical sound data produced by the musical sound producing means, wherein the musical sound producing apparatus includes a musical sound synthesizing means, and produces musical sound data which is formed by synthesizing the musical sound data and another sound data using the musical sound synthesizing means.

According to a second aspect of the present invention, the musical sound producing means of the first aspect of the invention includes a rhythm control means, and the musical sound data is processed using the rhythm control means.

According to a third aspect of the present invention, the musical sound producing means of the first aspect of the invention includes a repetition control means, and the musical sound data is processed using the repetition control means.

According to a fourth aspect of the present invention, the musical sound producing means of the first aspect of the invention includes an image database (hereinafter abbreviated as image DB) in which patterns are registered and an image matching means, wherein the image matching means detects a matching pattern from the image DB using a figure in the image data as a key, and the musical sound producing means produces musical sound data based on the matching pattern and the motion data.

According to a fifth aspect of the present invention, the musical sound producing apparatus of the first aspect of the invention includes a light emitting means, and the light emitting means emits light based on the musical sound data.

According to a sixth aspect of the present invention, the musical sound producing apparatus of the first aspect of the invention includes an image processing means, and the image processing means performs the image processing based on the musical sound data.

A seventh aspect of the present invention is a musical sound producing method which calculates motion data indicative of a motion from differentials of respective pixels corresponding to image data of a plurality of frames using image data of a frame as an input unit, and produces musical sound data containing a sound source, a sound scale and a sound level in accordance with motion data, wherein a musical sound synthesizing means is provided, and the musical sound data is produced by synthesizing the musical sound data and another sound data using the musical sound synthesizing means.

An eighth aspect of the present invention is a musical sound producing program which includes an operation part specifying step which extracts motion data indicative of motions from differentials of respective pixels corresponding to image data of a plurality of frames using image data of the frame as an input unit, a musical sound producing step which produces musical sound data containing a sound source, a sound scale and a sound level in accordance with the motion data specified by the operation part specifying step, and an output step which outputs the musical sound data produced by the musical sound producing step, wherein the musical sound producing step includes a musical sound synthesizing step, and produces musical sound data which is formed by synthesizing the musical sound data and another sound data using the musical sound synthesizing step.

A ninth aspect of the present invention is a recording medium which stores the program of the eighth aspect of the invention and is readable by a computer.

DETAILED DESCRIPTION OF THE INVENTION

Figure 1:
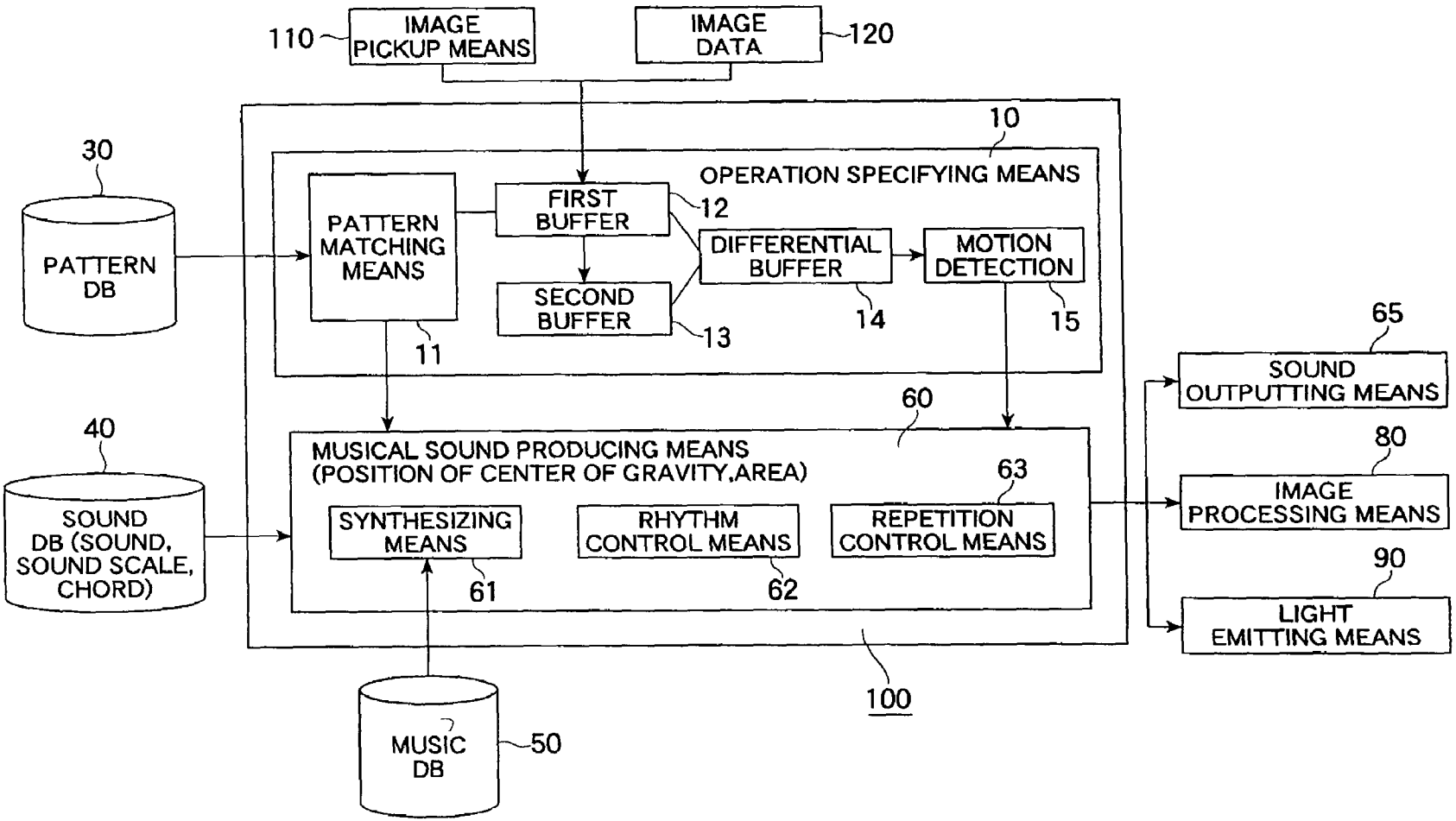
FIG. 1 is a constitutional view of a musical sound producing apparatus according to the present invention.

The present invention is explained in detail in conjunction with drawings hereinafter. FIG. 1 shows a first embodiment according to the present invention and is a constitutional view of a musical sound producing apparatus.

In FIG. 1, numeral 100 indicates a musical sound producing apparatus which constitutes a musical sound producing means according to the present invention. Numeral 110 indicates an image pickup means which inputs continuous image data into the musical sound producing apparatus 100 as frames. Numeral 120 indicates continuous image data per frame from another apparatus, that is, a motion picture per se which is outputted per frame from a camera, a personal computer, a recording medium or the like, for example.

An operation specifying means 10 is provided to the musical sound producing apparatus 100, and the operation specifying means has a function of detecting the motion based on the inputted image data with respect to image data which is outputted from the image pickup means 110 and the image data 120 from another device. The continuous motion picture is inputted with the number of frames ranging from 10 to 30 frames per sec in general at present. The operation specifying means 10 includes a first buffer 12 which reads the continuous frames and a second buffer which stores one-step preceding read frame. First of all, the frame of motion picture data is read by the first buffer 12, a content of the frame is transmitted to the second buffer 13, and the next frame is read by the first buffer. Due to the repetition of such an operation, the image frame which follows the frame of the second buffer is always read by the first buffer, and a comparison between both frames of the first buffer and the second buffer is continuously performed.

The frame information of the image data read by the first buffer 12 is transmitted to the second buffer 13 after the extraction whether the figure registered by the matching means 11 is contained in the frame information or not. The matching means 11 takes out the determination whether the figure registered in the pattern database (hereinafter abbreviated as a pattern DB) exists in the first buffer 12 or not by matching and transmits the determination to the musical sound producing means 60. Here, the pattern matching means 11, first of all, extracts a profile based on an analysis of the image data of the first buffer 12, generates a pattern which is obtained by adding the modification such as the enlargement, the contraction or the rotation to the profile figure, and inspects whether the pattern is contained in the registered patterns registered in the pattern database (hereinafter abbreviated as a pattern DB) or not.

The image data of the first buffer 12 and the image data of the second buffer 13 are continuous frames, a differential of respective pixels of both images is extracted to a differential buffer 14, and a motion detecting part 15 extracts the motion data between the frames based on the differential. With respect to respective pixel values of the image data of the first buffer and the image data of the second buffer, when all pixels differ from each other, it is impossible to make the distinction among whether light is applied to the whole pixels, the whole image is moved or the image is irrelevant to each other or not and hence, the image data is transmitted to the next frame without distinguishing the motion. When all pixel differences are zero, the still image is formed or the motion is not detected and hence, the frame feeding is performed to a frame which exhibits the next motion. The detection of the difference is performed such that the pixels having the respective color value differences of R, G, B which are equal to or more than fixed threshold values at both frames are extracted as pixels having the differences, a group of the pixels having the differences are taken out as "islands", sizes of the taken-out respective islands are treated as area values which is substituted with the number of pixels having the differences, and the islands having the area values which are equal to or less than the threshold value are ignored. The extraction of the differentials may be performed based on not only the differential of brightness but also the differential of color, wherein the motions is picked up for every color by obtaining the differentials of colors for respective colors.

The motion detecting part 15 prepares a list using X coordinates, Y coordinates of the center of gravity and the area values of respective islands indicative of the difference of both frames and outputs the list to the musical sound producing means 60.

The musical sound producing means 60 includes sound database (hereinafter abbreviated as sound DB) 40 which registers the pixels, the gray scales and chords therein, the musical sound producing means 60 takes out corresponding sounds from positions and areas of respective islands of the frame data transmitted from the operation specifying means 10 and outputs parameters of musical sound data in conformity with the standard MIDI (Musical Instruments Digital Interface) which performs transaction with musical sound data as musical sound data.

A synthesizing means 61 in the musical sound producing means 60 reads out analog data or digital data from a music database (herein after abbreviated to as music DB) 50 which stores existing bars, melodies, music or the like. The analog data is once converted into digital data, while the digital data is directly pulled out. The analog data or the digital data is synthesized with musical sound data based on the MIDI data which is outputted from the motion detecting part, and the synthesizing digital data is produced as parameters of the MIDI.

A rhythm control means 62 in the musical sound producing means 60 is provided for modifying or changing rhythm or tempo of the music or the like with the produced musical sound data. That is, the rhythm control means 62 has a function of taking out time elements from the motion data expressed by the MIDI of the operation specifying means 10 so as to speed up or delay the above-mentioned rhythm or tempo using a repeated cycle during the frame.

A repetition control means 63 in the musical sound producing means 60 has a function of taking out time elements from the motion data expressed by the MIDI of the operation specifying means 10 and repeatedly emitting the produced musical sound data using a repeated cycle during the frame.

The above-mentioned data may be outputted as sound from a sound outputting means 65, or may be outputted by producing a specified image using an image processing means 80, or may be outputted by flickering light or the like using a light emitting means 90.

Figure 2:
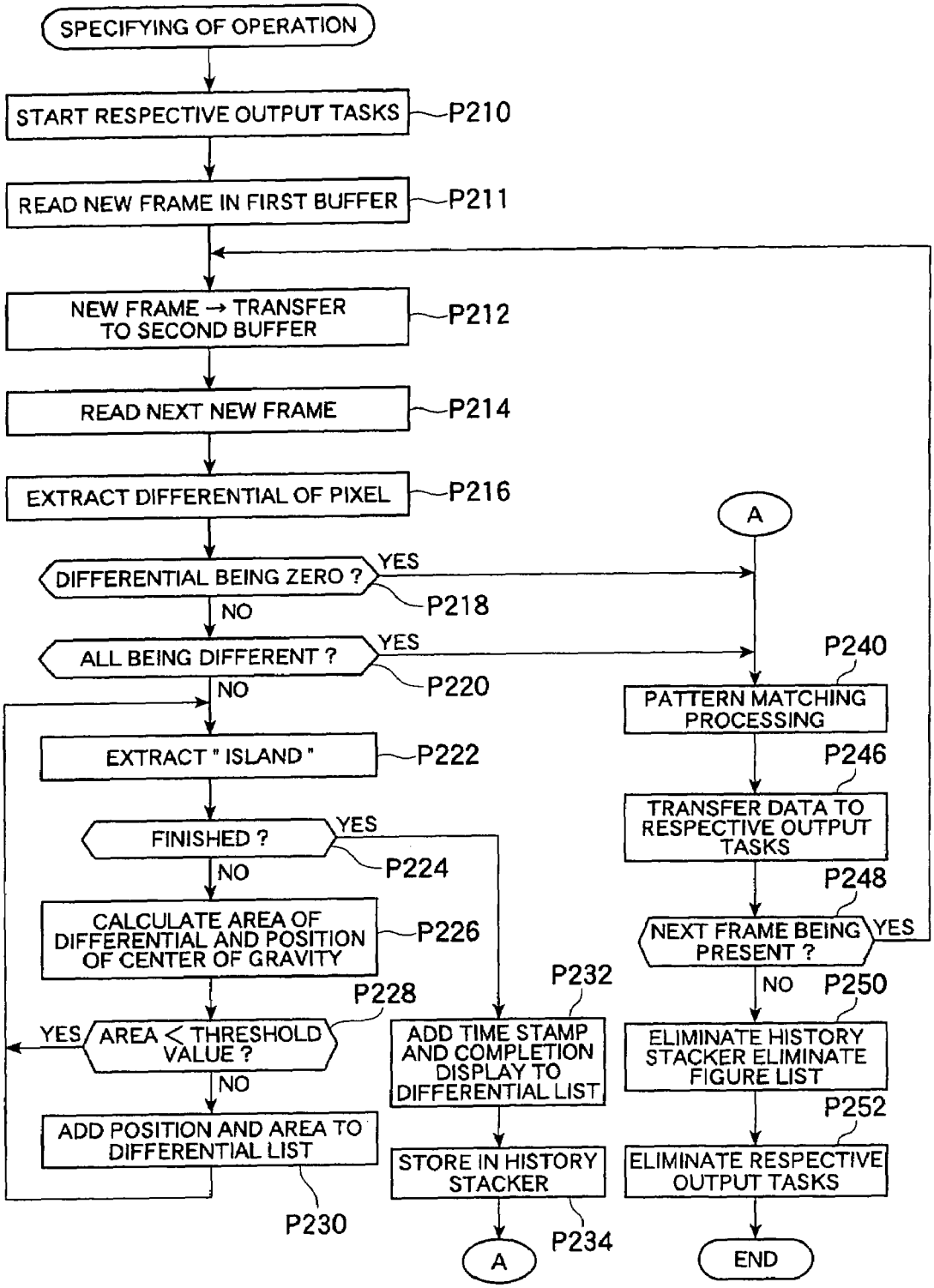
FIG. 2 is a flow chart for specifying operations of a musical sound producing program according to the present invention.

FIG. 2 to FIG. 7 show a second embodiment of the program according to the present invention, wherein the second embodiment relates to a musical sound producing program. Hereinafter, the musical sound producing program is explained. FIG. 2 is a flow chart of the whole program processing. The program shown in FIG. 2 is an embodiment which is executed as one task under a control of an operating system. In step P210, respective tasks for sound outputting, image outputting and light outputting are started. In this embodiment, the respective output tasks are separately generated and are configured to receive subsequent music data attributed to differentials as "phenomenon standby". To be more specific, a group of slave tasks such as a sound task, an image task, a light task and the like whose processing are executed independently from each other in parallel are separately started, these tasks are in a state that the tasks wait for a specific phenomenon to be processed, the generation of a phenomenon of musical sound data in this case. When a program which specifies a main operation constituting a master task produces musical sound data and the processing phenomenon is specifically generated, the slave tasks are started along with the musical sound data. Accordingly, simultaneously with the production of the musical sound data, the musical sound data is transmitted to the respective slave tasks and hence, the slave tasks perform the respective outputting processing in parallel. However, when it is desirable to output an effect in which the sound, the image and the light are synchronized with each other, these may be processed by a single task which has the addition of sound with a fixed delay to the motion of the image, for example, or the respective tasks may be configured to have outputs thereof synchronized using a synchronizing command. Further, starting of the respective tasks may be performed at the time of performing another initialization when necessary or may be performed separately.

Subsequently, in step P211, a first frame for producing musical sound is read in the first buffer. In step P212, to subsequently read a second frame, the content of the read first buffer is transferred to the second buffer, and again, in step P214, next new frame is read in the first buffer. The above-mentioned steps are steps for always storing the most updated frame in the first buffer and for storing the content of the immediately preceding frame in the second buffer. Using these two buffers, in step P216, pixels of respective images of the continuous input frames are compared and difference is taken out.

As processing for obtaining the difference between both frames in step P216, first of all, with respect to the respective pixels corresponding to the frames, the differences for every color of respective pixels are calculated, and a group of pixels which have differences equal to or more than fixed values from peripheries thereof are taken out as an "island". This island is not only a group of pixels which have the same difference values but also a group of pixels which have values of differences having some width. Further, as an area value of each island, the number of pixels which constitutes the island is counted.

In step P218, when all color values of the respective pixels of both images which are compared to each other are equal to or below the fixed values, this implies a case in which the still image is formed or the continuous frames with no motion are formed and hence, the differences of all pixels are zero. In this case, the processing advances to step P240 where the matching processing whether the registered figure is contained or not is performed. When the differences equal to or more than the fixed value are present between the pixels of the images which are compared to each other, in step P220, it is determined whether all pixel values are equal to or more than the fixed value. When both images are images which are completely different from each other or, when the light is projected to the whole images and the pixels which have the same color values are not present or, figures with a fine pattern are moved at a high speed, there arises a case in which the movement of the figure is not detected as the movement of the image. Also when all color values of the pixels corresponding to both images differ from each other with the values equal to or more than the fixed values, the processing advances to step P240. Accordingly, the condition which allows the processing to arrive at step P222 depends on whether a portion where the color values differ from each other with a fixed value or more and portions where the color values are equal to each other with the fixed value or less in respective pixels which correspond to each other in the frames, and the motion is determined based on such the presence of these portions.

In step P222, the groups which form pixels having close difference values are detected one after another as "islands". When there are no more islands to be taken out, after completing processing taking out the islands in step P224, the processing advances to step P232. When one island is taken out, an area of the island and the center of gravity of the pixels which constitute the island are calculated in step P226. An object whose value does not arrive at a fixed threshold value is inspected in step P228 and is ignored as a trivial island and the processing returns to step P222 in which the next island is taken out and is inspected. When the area of the island exceeds the fixed threshold value, in step P228, an entry having the center-of-gravity position of the island is registered in a differential list for producing musical sound, the area and an average color value of the respective dots are added, and the processing returns to step P222 for taking out the next island.

Figure 7:
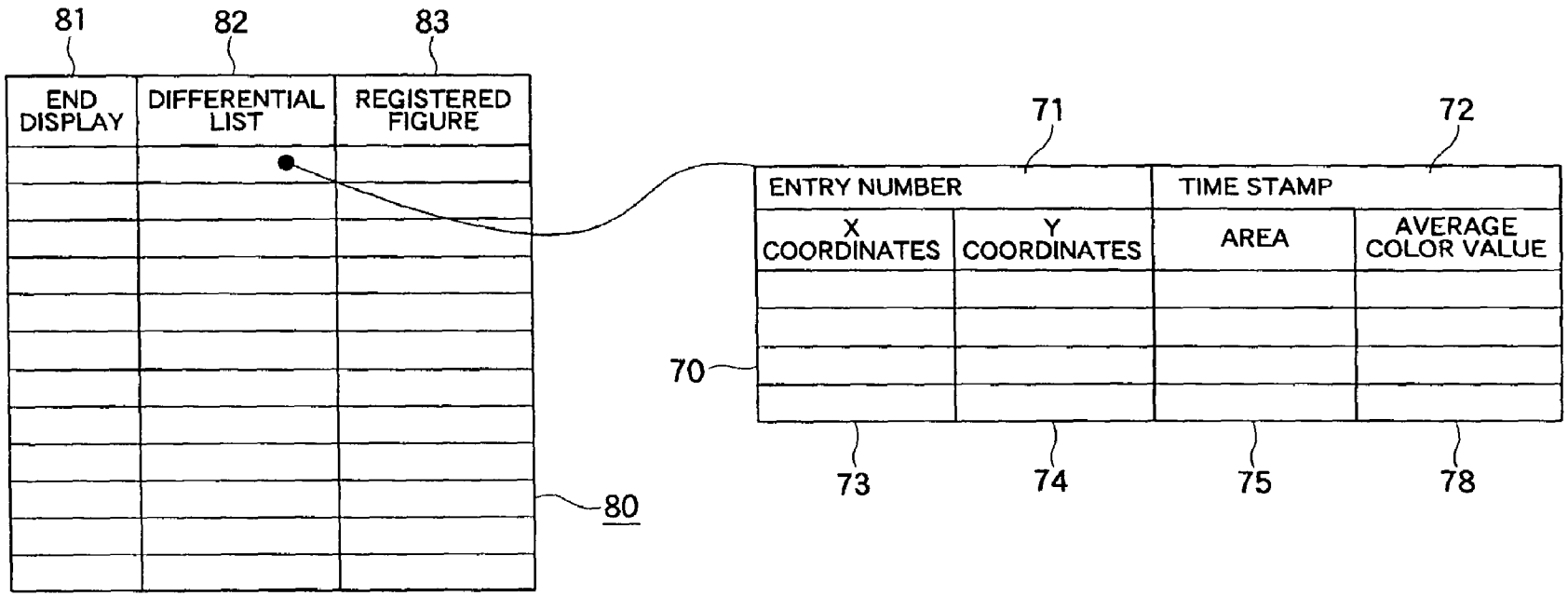
FIG. 7 is a view of one constitutional example of a differential list and a history stack.

FIG. 7 is a constitutional view of one embodiment of a history stacker 80 and a differential list 70, wherein the respective detected islands are registered in the differential list 70. The history stacker 80 stacks the respective detected islands time-sequentially. The differential list 70 includes an entry number column 71 which records the number of islands detected for every frame which becomes an analysis object, and a time stamp column 72 which records times of the detections. In the differential list 70, the entry which is formed of a pair of an X coordinates 73 and a Y coordinates 74 of each island is produced for every island, and the area and the average color value of the island are stored in the column as an area column 75 and an average color value column 76 in step P230.

When the extraction of the island is completed, in step P232, the processing time is filled out in the time stamp column 72 of the differential list 70, the final column number is stored in the entry number column 71. In step P234, the differential list is added to the history stacker 80, and the processing advances to step P240 where the pattern matching processing is performed. In step P240, the pattern matching processing for determining whether the registered pattern exists in the content of the first buffer or not is performed. The detail of the pattern matching processing is explained in conjunction with FIG. 3. In the pattern matching processing in step P246, when the registered figure is found, the registered figure which is recorded in a registered figure column 83 of the history stacker 80 is found in the single frame and returns together with a parameter value which constitutes a figure column as a figure list.

The history stacker 80 includes a completion display column 81 which displays the completion of entry, a differential list column 82 which allows the entry of the differential lists 70 of respective islands therein, and the registered figure column 83 in which the registered figure is written when it is determined that the islands are the registered figures.

Figure 4:
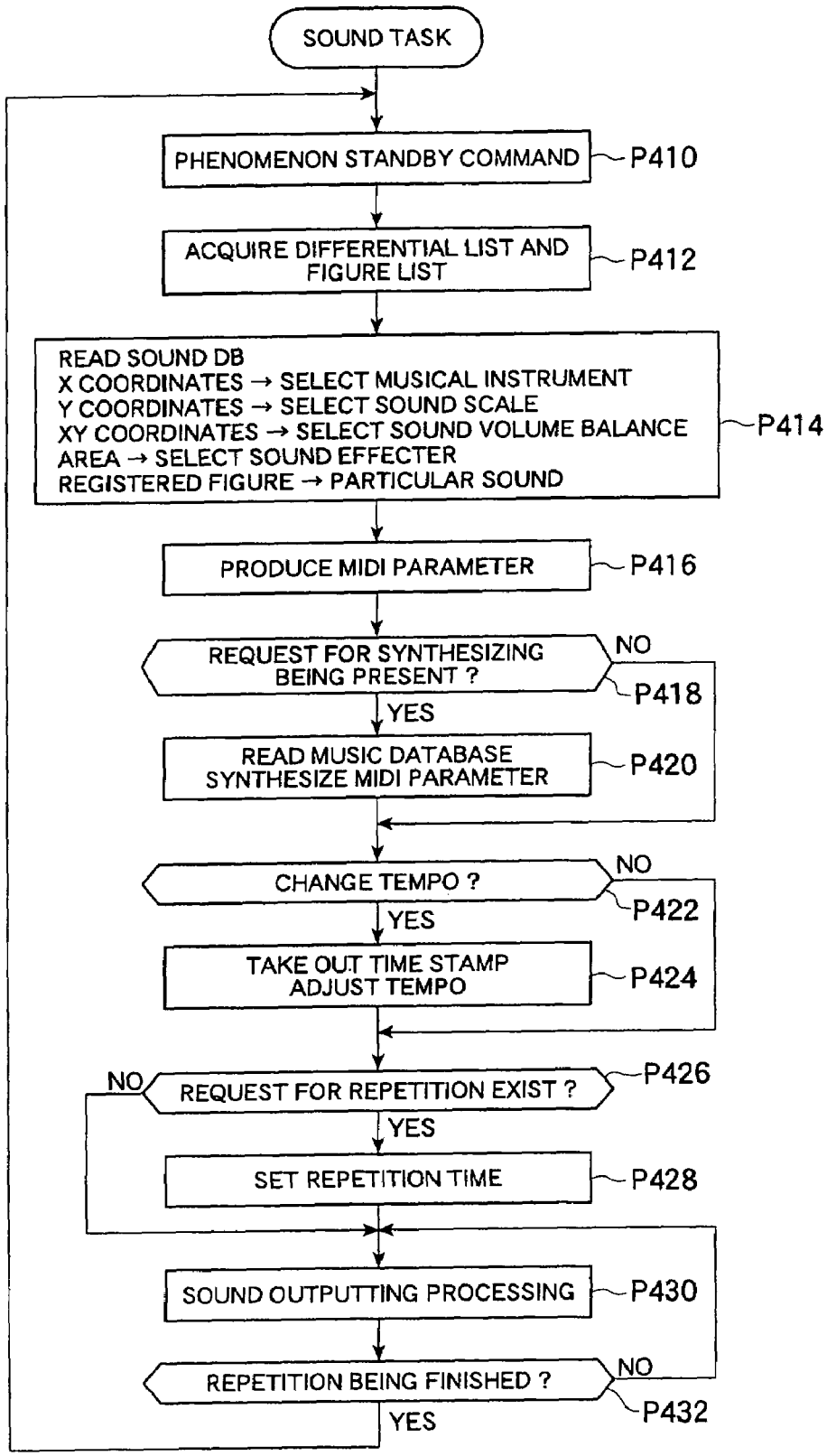
FIG. 4 is a flow chart of a sound task according to the present invention.
Figure 5:
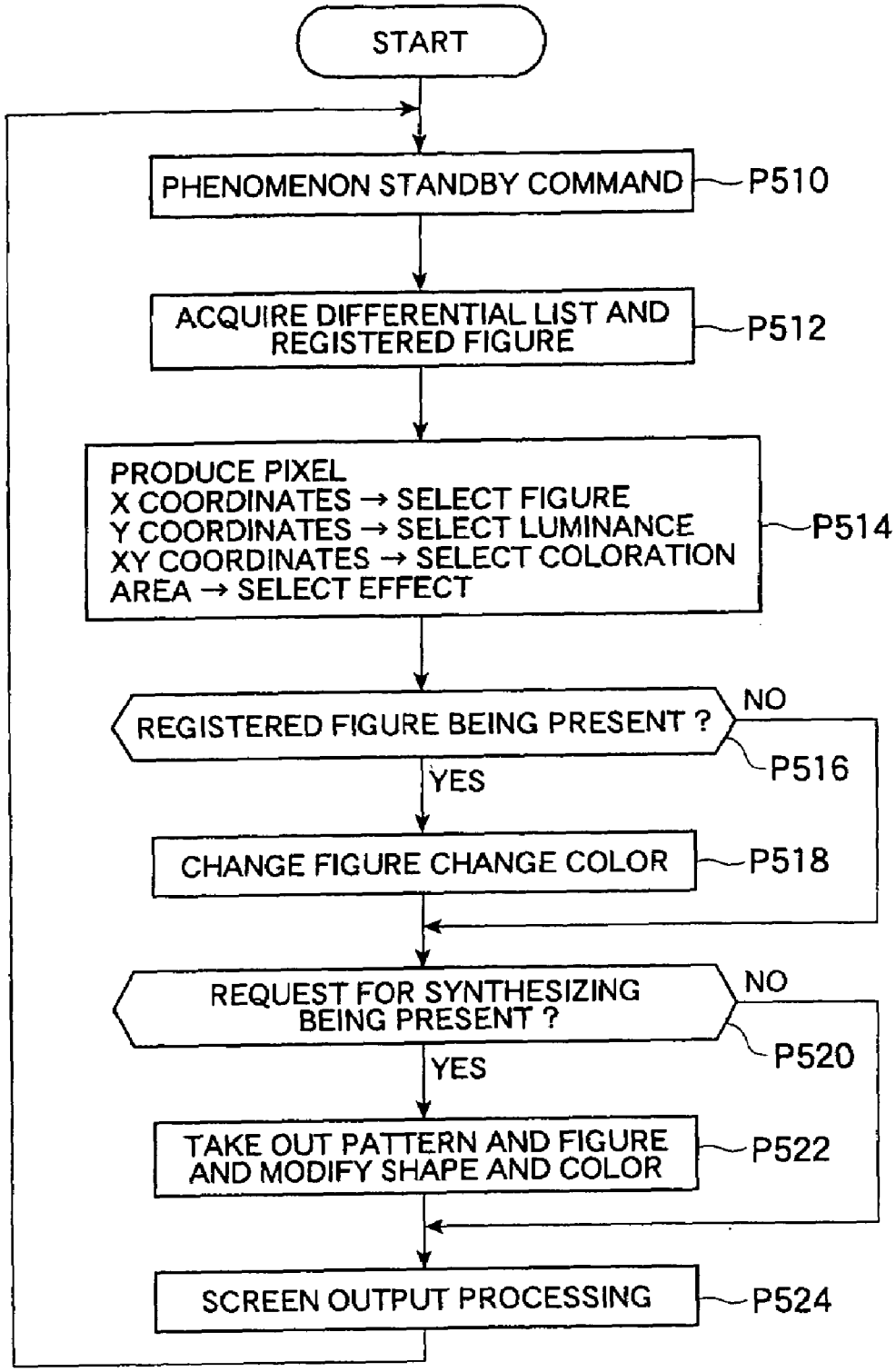
FIG. 5 is a flow chart of a figure task according to the present invention.
Figure 6:
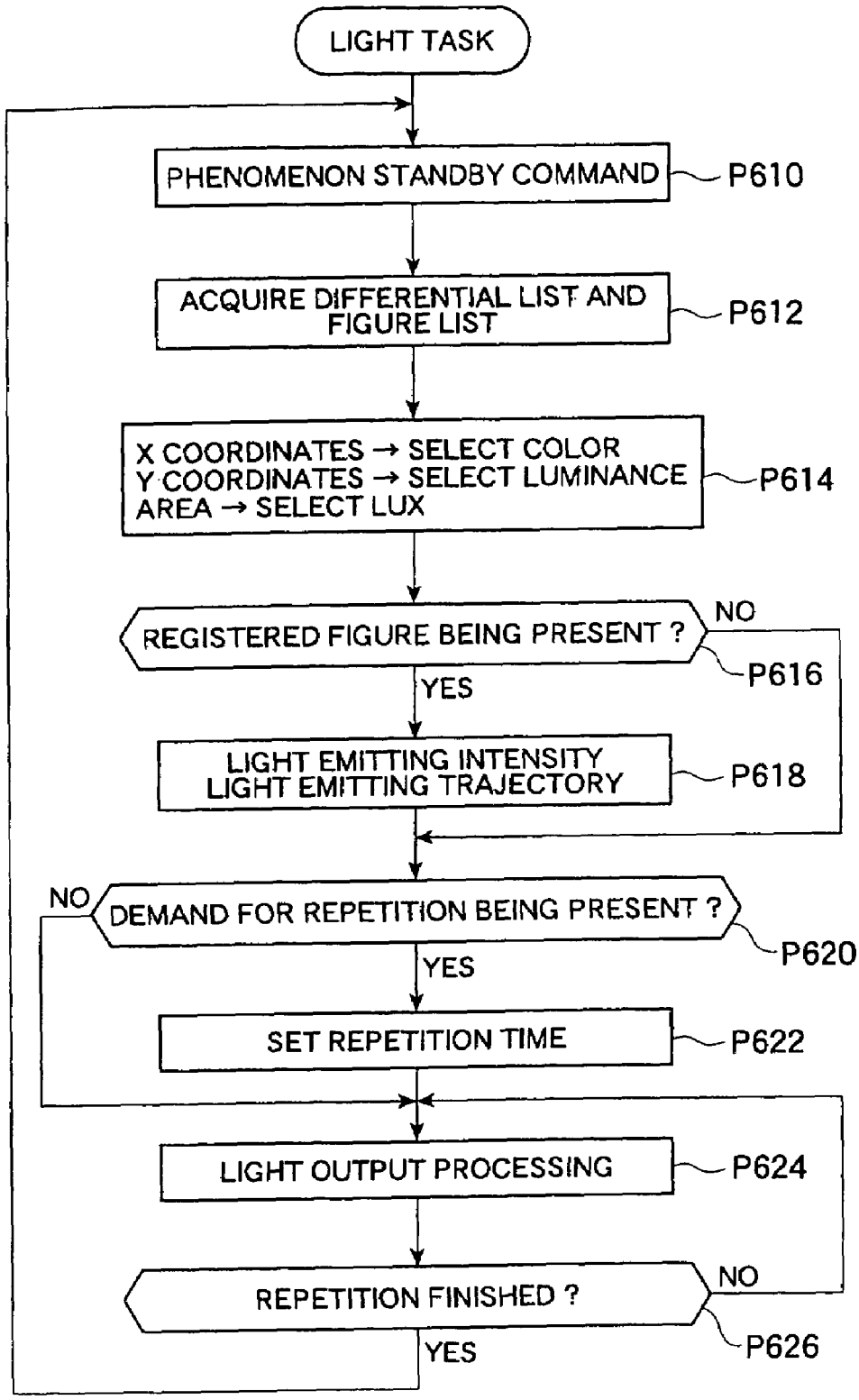
FIG. 6 is a flow chart of an optical task according to the present invention.

Step P246 is processing for transferring data to respective output tasks, wherein the processing transmits a phenomenon generation informing command to the operating system using a most updated column of the history stacker 80 which contains the differential list indicative of the movement as a parameter. Output processing as respective tasks is shown in FIG. 4, FIG. 5 and FIG. 6. When the next frame exists in step S248, the processing returns to reading step P212 in which the frame as read as a new frame. When it is determined that the processing is determined to be processing of the final frame in step P248, a series of differentials, detected figures, and the figure list when the figure list exists which are stored in the history stacker 80 in step P250 are eliminated, and respective output tasks are eliminated in step P252 thus completing the operation specifying processing. With respect to the elimination of the tasks, in this embodiment, the whole tasks which are started are completed along with the completion of the input frame. However, it is not always necessary to complete the whole tasks in synchronism with the completion of the frame input, and a repetition mode in which the tasks are continuously executed after stopping the input image, a continuation mode in which an alarm output is continued in response to the detection of an urgent state, or a continuation mode for synthesizing or editing music or the like may be continued. That is, it may possible to adopt a system in which the respective tasks are individually eliminated in response to the detection of processing conditions, and the output tasks may be freely constituted.

Figure 3:
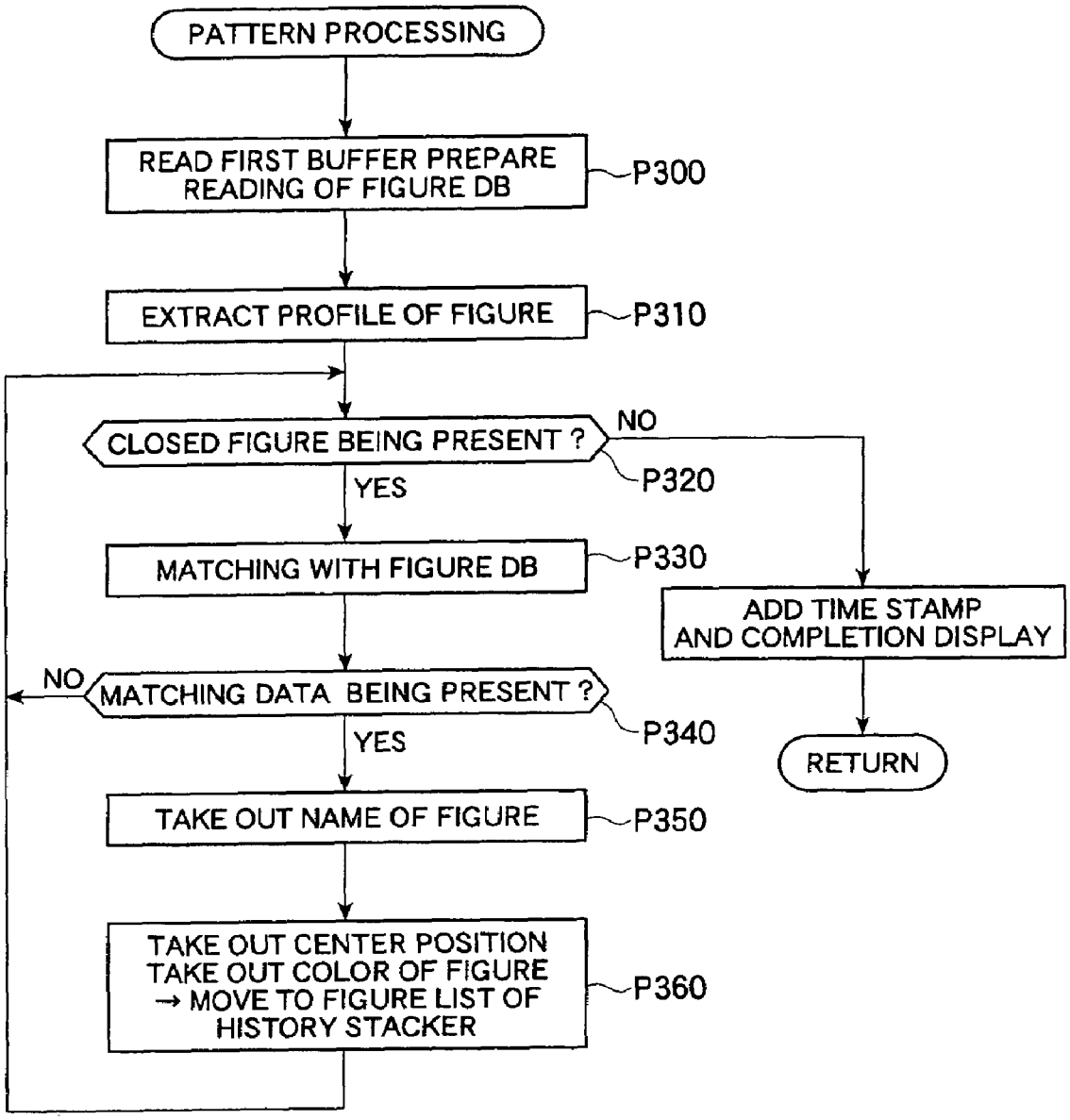
FIG. 3 is a flow chart of a matching processing according to the present invention.

FIG. 3 is a flowchart of the matching processing executed in step P240 shown in FIG. 2. In step P300, the content of the first buffer is read and the preparation for access to the pattern DB in which the matching figure is registered is performed. In step P310, with respect to the content of the first buffer, a profile of the figure is taken out by a general technique by calculating the difference of color values, for example. In step P320, it is determined whether a closed loop exists in the taken-out profiles in succession or not and, when the closed loop exists in the taken-out profile in step S330, the figure is normalized by processing such as the enlargement, and the matching whether the similar figure is contained in the figures registered in the pattern DB or the like is performed.

When the matching date is not found by the inspection in step P340, the processing returns to step P320 where the closed figure is taken out again. When the matching data is found, the name of the matched figure (FIG. 1D) is taken out in step P350. Next, in step P360, in addition to the name of the figure, a center position of the figure and color of the figure are taken out and are added to a figure list (not shown in the drawing). The figure list is a list which stores information of registered figure contained in the frames and is added to the registered figure column 83 of the history stacker 80. When the extraction of the whole registered figures in the most updated frame which becomes the object to be inspected in step P320 is completed, the display of the completion is added to the last column 83 of the history stacker 80 of the figure list in step S370, the processing time is stored in the time stamp column, the completion of extraction of registered figures is called as a parameter list, and the processing returns to the initial step.

FIG. 4 is a flowchart of the sound task. The sound task which is generated in step P210 in FIG. 2, first of all, generates a phenomenon wait command for the operating system in step P410 and waits until the sound task is called with the sound data from step P246 shown in FIG. 2. When the sound task is called in response to a calling command, the calling parameter indicates the history list or the figure list, and in step P412, the differential list 70 and the registered figure are take out using the completion display column 81 of the history stacker or the display of the last entry of the figure list as the completion condition. In step P414, first of all, the sound DB is read and, based on the differential list 70 and the registered figure which are taken out, a type of musical instrument is selected using the X coordinate as a key, a sound scale is selected using the Y coordinate as a key, a sound volume balance is selected using the XY coordinates as a key, a type of a sound effecter is selected using an area as a key, and a special sound is selected using the registered figure as a key respectively. In executing the above-mentioned processing, parameters are adjusted in accordance with the MIDI standard in step P416.

In step P418, it is determined whether a request for synthesizing the produced sound data and other sound data exists or not. When the synthesizing request of the sound data exists, music, bar, melody and the like to be synthesized are read from the music database DB and are synthesized in step P420. The synthesizing may be performed using a digital signal processor.

It is determined whether there exists a request for changing the tempo such as the tune, the bar, the melody or the like which is produced in step P422. When there exists the request for changing the tempo, for example, the time stamp having the same registered figure is particularly taken out, and the processing such as gradual matching of an interval of the tune which becomes an object to the interval of repetition of the time stamp is performed. It may be possible to adopt a technique which changes the interval of the tune in conformity with a cycle of the time stamp which sharply detects the rhythm of the tune.

In step P426, it is determined whether a request for repetition exists or not. When the repetition is designated, a cycle of the repetition and finishing condition of the repetition are set in step P428. Here, by taking out a value of the time stamp 72 of the differential list 70 which is registered in the history stack 80 and by taking the difference between the detected time stamp and the value of the time stamp, it is possible to take out a cycle of the change of the figure based on the difference.

In step P430, sound output processing is executed and the above-mentioned digital sound signals are converted into analogue sound signals and are outputted from a speaker or the like.

In step P432, it is determined whether the condition of repetition set in step P428 is satisfied or not. When the condition of repetition is not satisfied, the procedure returns to step P430 and starts the sound outputting processing again, while when the condition of repetition is finished, the procedure returns to step P410 of phenomenon standby for producing sounds corresponding to the movement of next frame again.

FIG. 5 is a flow chart for the figure task. In the figure task which is produced in step P210 in FIG. 2, first of all, in step P510, a phenomenon standby command is supplied to the operating system and the operating system stands by the calling of the figure task with sound data from step P246 shown in FIG. 2. When the figure task is called in response to a calling command, a calling parameter indicates the history list or the figure list, and the differential list 70 and the registered figure are taken out using the final display column 81 of the history stacker or the final entry display of the figure list as the finishing condition in step P512. In step P514, first of all, the image data base (hereinafter abbreviated as image DB) in which the pixels are registered are read out, and based on the differential list 70 and the registered figure which are taken out, a kind of the figure is selected using an X coordinate as a key, the luminance of the figure is selected using a Y coordinate as a key, the coloration of the figure is selected using the XY coordinates as a key, a kind of a figure effecter is selected using an area as a key, and the particular figure is selected using the registered figure as a key. In step P516, it is determined whether the registered figure is in the history list or not. When the registered figure is in the history list, in step P518, in accordance with a promise on various figure drawings corresponding to the registered figure, the change of the figure or the change of the color is performed. In step P520, it is determined whether there exists a request for synthesizing sound data produced in step 520 and other sound data. When there exists the request for synthesizing the sounds, in step P522, a design, a photograph or the like to be synthesized is read out from the image DB and is synthesized. This synthesis may be performed using an application program of the various image processing.

Image output processing is executed in step P524 to allow various display devices to display image data.

FIG. 6 is a flow chart for the figure task. In the light task which is produced in step P210 in FIG. 2, first of all, in step P610, a phenomenon standby command is supplied to the operating system and the operating system stands by the calling of the light task with sound data from step P246 shown in FIG. 2. When the light task is called in response to a calling command, a calling parameter indicates the history list or the figure list, and the differential list 70 and the registered figure are taken out using the final display column 81 of the history stacker or the final entry display of the figure list as the finishing condition in step P612. In step P614, first of all, the light data base (hereinafter abbreviated as light DB) in which a list and a selection rule relevant to color, the hue and the luminance of light is read out, and based on the differential list 70 and the registered figure which are taken out, an emitting color is selected using an X coordinate as a key, the luminance is selected using a Y coordinate as a key, the hue is selected using the XY coordinates as a key, a light effecter is selected using an area as a key, and a particular light emission is selected using the registered figure as a key. In step P616, it is determined whether the registered figure is in the history list or not. When the registered figure is in the history list, in step P618, changes are applied to the emitted light beams such that the intensity of the emitted light beams are formed in a waveform or a trajectory of the emitted light beams is moved. In step P620, it is determined whether there exists a request for the repetition of the produced light data or not. When there exists the request for the repetition of the light data, the repetition time is set in step S622, and a lighting signal is outputted to a light emitting device in step P624. In step P626, it is determined whether the condition of repetition which is set in step P622 is satisfied or not. When the condition of repetition is not satisfied, the procedure returns to step P620 and the light outputting processing is started again, while when the condition of repetition is finished, the procedure returns to the phenomenon standby step P610 again for producing light in response to the movement of the next frame.

The elements to be selected corresponding to the above-mentioned coordinate values and the like and the elements from the various DB which becomes objects to be selected merely constitute one embodiment, and this embodiment is not limited to such elements to be selected or objects to be selected. That is, it is possible to register various elements in the various DB as the objects to be selected, and various different selections may be performed corresponding to an object and a purpose to be applied. The exchange, the change and the combination of the elements which constitute objects to be selected and various DB registered elements are all included in the scope of claim of the present invention.

Further, in the above-mentioned embodiments, the explanation is made with respect to the example in which the light emitting means and the image processing means are provided as the output means. However, the present invention is not limited to such an example, and the present invention is broadly applicable as a frame analysis sensor using the motion data detected based on frame difference. The use of the oscillation means, the power generating means and the various drive means as the output means is also included in the scope of the present invention.

Figure 8:
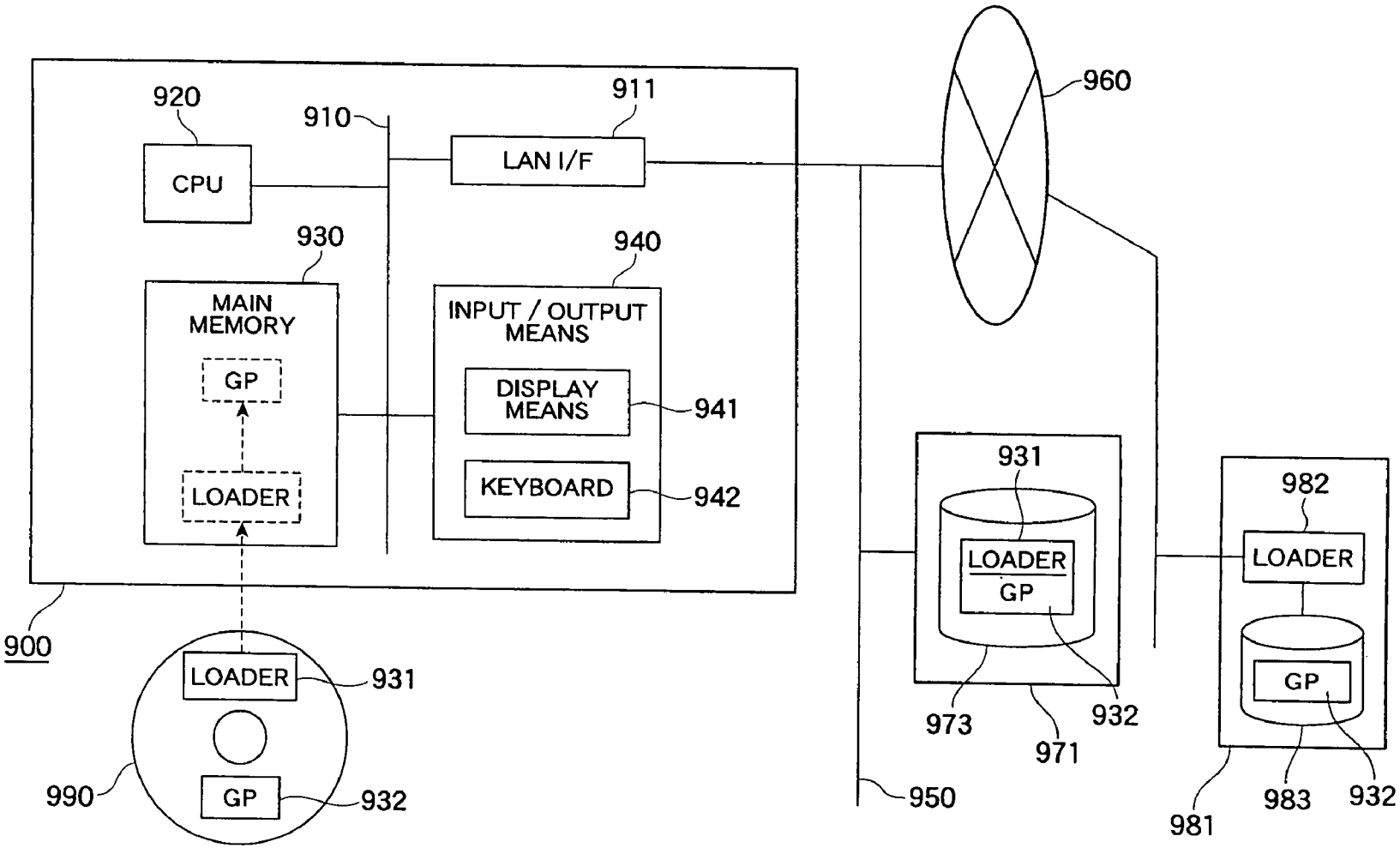
FIG. 8 is a view showing a recording medium which stores the musical sound producing program according to the present invention.

FIG. 8 is an explanatory view relating to a storage medium which stores the musical sound producing program relevant to the present invention.

Numeral 900 indicates a terminal device on which the present invention is expected to be put into practice. Numeral 910 indicates a bus to which a logic arithmetic device (CPU) 920, a main storage device 930, and an input/output means 940 are connected. The input/output means 940 includes a display means 941 and a keyboard 942 therein. In the storage medium (CD) 990, the program based on the present invention is stored as a musical sound producing program (GP) 932 in an execution mode. Further, a loader 931 which installs the program into the main storage device 930 is also stored in the storage medium (CD) 990. First of all, the storage medium (CD) 931 is read in the main storage device 930, and the musical sound producing program (GP) 932 is installed in the main storage device 930 by the loader 931. Due to such installation, the terminal device 900 functions as the musical sound producing apparatus 100 shown in FIG. 1.

The manner of operation of the musical sound producing apparatus 100 according to the present invention is not limited to the above-mentioned manner of operation. That is, it may be possible to load the musical sound producing program (GP) 932 based on the present invention to the terminal device 100 from a large-scale memory device 973 which is incorporated in a server 971 which is connected to a LAN 950 via a LAN interface LANI-F 911. In this case, in the same manner as the storage medium 990, first of all, a program loader 931 which installs the musical sound producing program (GP) 932 stored in the server 971 is read in the main storage device 930 via a LAN 950 and, thereafter, the musical sound producing program (GP) 932 in an execution mode in the large-scale storage device 973 is installed in the main memory device 930 using this loader.

Further, the musical sound producing program (GP) 932 according to the present invention which is stored in the large-scale memory device 983 incorporated in a server 981 which is connected via the Internet 960 may be directly installed using a working region of the main storage device 930 by a remote loader 982. In installing the musical sound producing program (GP) 932 via the Internet 960, in the same manner as the large-scale storage device 973 which is connected to the LAN 950, it may be possible to adopt a mode affiliated with the loader 931.

INDUSTRIAL APPLICABILITY

The present invention in its first aspect extracts the motion data indicative of the motion from the differential of respective pixels corresponding to the image data of the plurality of frames, and produces the musical sound data which is obtained by synthesizing the musical sound data produced based on the motion data and other sound data. Accordingly, it is possible to change the existing tunes along with the dancing posture or along with the change of a landscape outside an automobile.

The present invention in its second aspect provides the musical sound rhythm control means to the musical sound producing means of the first aspect of the invention and arranges the musical sound data using the rhythm control means and hence, for example, the musical sound producing apparatus can play musical sounds with rhythm matching the motion on images and, a listener can listen the tunes having a comfortable rhythm with fluctuation in conformity with the motion of a carp-shaped streamer which flutters with wind.

The present invention in its third aspect provides the repetition control means to the musical sound producing means of the first aspect of the invention and arranges the musical sound data by the repetition control means and hence, it is possible to add echo to the musical sounds or repeatedly notify an alarming sound when a dangerous motion is detected.

The present invention in its fourth aspect provides the image matching means to the musical sound producing means of the first aspect of the invention and produces the musical sound data based on the matching pattern which is extracted from the image data base which is registered using the figure in the image data as the key and hence, it is possible to produce the musical sound data which may be similar in form but different from each other due to the difference in motion and hence, for example, it is possible to easily detect a situation in which a similar object which is mounted on an automobile or an automatic machine and is prepared by taking the safety into consideration falls into danger due to an unexpected motion.

The present invention in its fifth aspect provides the light emitting means to the musical sound producing apparatus of the first aspect of the invention and the light emitting means emits light based on the motion data and hence, for example, it is possible to change the illumination in conformity with the motion on a stage or notifies a dangerous motion by emitting light when an automobile or the like detects the dangerous motion.

The present invention in its sixth aspect provides the image processing means to the musical sound producing apparatus of the first aspect of the invention and the image processing means performs the image processing based on the musical sound data and hence, a viewer can enjoy deformed images of the motion of the object such as images which emphasizes the motion of an actor or an animal, for example.

The seventh aspect of the present invention is the method which calculates the motion data indicative of the motion from the differentials of the respective pixels corresponding to the image data and produces the musical sound data which is obtained by synthesizing the motion data and other sound data and hence, it is possible to change the existing tune along with the dancing posture or along with the change of a landscape outside an automobile.

The eighth aspect of the invention is the program which calculates the motion data indicative of the motion from the differentials of the respective pixels corresponding to the image data and produces the musical sound data which is obtained by synthesizing the motion data and other sound data and hence, it is possible to change the existing tunes along with the dancing posture or along with the change of a landscape outside an automobile.

The ninth aspect of the invention is the storage medium which is capable of recording the program of the eighth aspect of the invention using a computer and is readable by a computer and hence, it is possible to easily convert the computer in general into the musical sound producing apparatus.

The invention claimed is:

1. A musical sound producing apparatus comprising:

an operation part specifying means which extracts motion data indicative of motions from differentials of respective pixels corresponding to image data of a plurality of frames using image data for respective frames as an input;

a musical sound producing means which produces musical sound data containing a sound source, a sound scale and a sound level in accordance with the motion data specified by the motion part specifying means; and an output means which outputs the musical sound data produced by the musical sound producing means, wherein the musical sound producing means includes a musical sound synthesizing means, and produces musical sound data which is formed by synthesizing the musical sound data and another sound data using the musical sound synthesizing means.

2. A musical sound producing apparatus according to claim 1, wherein the musical sound producing apparatus includes a rhythm control means, and the musical sound data is processed using the rhythm control means.

3. A musical sound producing apparatus according to claim 1, wherein the musical sound producing apparatus includes a repetition control means, and the musical sound data is processed using the repetition control means.

4. A musical sound producing apparatus according to claim 1, wherein the musical sound producing apparatus includes an image database (hereinafter abbreviated as image DB) in which patterns are registered and an image matching means, wherein the image matching means detects a matching pattern from the image DB using a figure in the image data as a key, and the musical sound producing means produces musical sound data based on the matching pattern and the motion data.

5. A musical sound producing apparatus according to claim 1, wherein the musical sound producing apparatus includes a light emitting means, and the light emitting means emits light based on the musical sound data.

6. A musical sound producing apparatus according to claim 1, wherein the musical sound producing apparatus includes an image processing means, and the image processing means performs the image processing based on the musical sound data.

7. A musical sound producing method comprising:

calculating motion data indicative of a motion from differentials of respective pixels corresponding to image data of a plurality of frames using image data for respective frames as an input unit, and producing musical sound data containing a sound source, a sound scale and a sound level in accordance with the motion data, the musical sound data being produced by synthesizing the musical sound data and another sound data.

8. A computer-implemented musical sound producing program embodied on a computer-readable medium and which causes a computer to execute an operation part specifying step which extracts motion data indicative of motions from differentials of respective pixels corresponding to image data of a plurality of frames using image data for the respective frames as an input unit, a musical sound producing step which produces musical sound data containing a sound source, a sound scale and a sound level in accordance with the motion data specified by the operation part specifying step, and an output step which outputs the musical sound data produced by the musical sound producing step, the musical sound producing step including a musical sound synthesizing step, and produces musical sound data which is formed by synthesizing the musical sound data and another sound data using the musical sound synthesizing step.

9. A recording medium on which the program of claim 8 is stored and is readable by a computer.

* * * * *